US010267531B2

(12) United States Patent
Lee et al.

(10) Patent No.: US 10,267,531 B2
(45) Date of Patent: Apr. 23, 2019

(54) COOLING AND HEATING CONVERSION DEVICE, CONTROLLING THE SAME AND AIR CONDITIONING SYSTEM

(71) Applicant: Samsung Electronics Co., Ltd, Gyeonggi-do (KR)

(72) Inventors: Dong-kue Lee, Pyeongtaek-si (KR); Jeong-mun Yeom, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/851,540

(22) Filed: Dec. 21, 2017

(65) Prior Publication Data

US 2018/0172311 A1 Jun. 21, 2018

(30) Foreign Application Priority Data

Dec. 21, 2016 (KR) ..... 10-2016-0175389

(51) Int. Cl.
*F24F 3/00* (2006.01)
*F24F 11/84* (2018.01)
(Continued)

(52) U.S. Cl.
CPC ..... *F24F 11/84* (2018.01); *F24F 1/00* (2013.01); *F24F 11/64* (2018.01); *F24F 2001/0074* (2013.01)

(58) Field of Classification Search
CPC ..... B60H 1/00899; F24F 5/0003; F24F 11/84; F24F 11/64; F24F 1/00; F24F 2001/0074; C09K 5/045
(Continued)

(56) References Cited

U.S. PATENT DOCUMENTS 6,003,323 A * 12/1999 Sumida ..... C09K 5/045 62/175
6,065,302 A * 5/2000 Sada ..... F24F 5/0003 165/104.24
(Continued)

FOREIGN PATENT DOCUMENTS

JP 2006207949 A 8/2006
JP 2012202208 A 10/2012
(Continued)

OTHER PUBLICATIONS

ISA/KR, "International Search Report an d Written Opinion of the International Searching Authority," International Application No. PCT/KR2017/015081, dated Apr. 17, 2018, 13 pages.

*Primary Examiner* — Davis D Hwu

(57) ABSTRACT

According to an embodiment of the present disclosure a cooling and heating system includes a plurality of branch holes configured to provide different refrigerants to at least one indoor units. The device also includes a plurality of valves configured to respectively correspond to the plurality of branch holes wherein each valve is configured to select a refrigerant to be provided to at least one indoor unit. The different refrigerants are provided from an outdoor unit. The device further includes a plurality of ports configured to respectively correspond to the plurality of branch holes. The device also includes a processor configured to, in response to an input through the plurality of ports that include an indoor unit information including refrigerant information, control each of the plurality of valves to provide refrigerant corresponding to the refrigerant information through a branch hole corresponding to a port that the refrigerant information is input.

20 Claims, 8 Drawing Sheets

(51) Int. Cl.
*F24F 11/64* (2018.01)
*F24F 1/00* (2019.01)

(58) Field of Classification Search
USPC ..... 165/218
See application file for complete search history.

(56) References Cited

U.S. PATENT DOCUMENTS

| | | | | |
|---|---|---|---|---|
| 7,340,909 | B2 | 3/2008 | Kwon et al. | |
| 2009/0139251 | A1 | 6/2009 | Masui | |
| 2009/0205353 | A1* | 8/2009 | Takahashi ..... | B60H 1/00899 62/324.1 |
| 2012/0042674 | A1 | 2/2012 | Takenaka et al. | |
| 2016/0084551 | A1 | 3/2016 | Hur et al. | |

FOREIGN PATENT DOCUMENTS

| | | | |
|---|---|---|---|
| KR | 100529952 | B1 | 11/2005 |
| KR | 10-2006-0073177 | A | 6/2006 |
| KR | 100624000 | B1 | 9/2006 |
| KR | 10-2008-0060762 | A | 7/2008 |
| KR | 20080060757 | A | 7/2008 |
| KR | 10-2011-0102042 | A | 9/2011 |

* cited by examiner

COOLING AND HEATING CONVERSION DEVICE, CONTROLLING THE SAME AND AIR CONDITIONING SYSTEM

CROSS-REFERENCE TO RELATED APPLICATIONS

This application is related to and claims priority to Korean Patent Application No. 10-2016-0175389 filed on Dec. 21, 2016, the disclosure of which is incorporated herein by reference in its entirety.

TECHNICAL FIELD

Devices and methods consistent with what is disclosed herein relate to a cooling and heating conversion device, a controlling method thereof and an air conditioning system, and more particularly, to a cooling and heating conversion device for obtaining information of a connected indoor unit without manually setting by a user, a controlling method thereof and an air conditioning system.

BACKGROUND

An air conditioner is a device that is placed in a house, an office, a shop, a green house, or the like and maintains indoor environment to be pleasant for people to live or to be suitable for crops to be grown by adjusting temperature, humidity, cleanliness and air flow.

Recently, a multi-air conditioner system has been widely used, where a plurality of indoor units are connected to a single outdoor unit, since buildings have become large and there has been an attempt to reduce spaces for an outdoor unit.

Typically, the multi-air conditioner system may include an outdoor unit, a plurality of indoor units which are connected to the outdoor unit in parallel and a cooling and heating conversion device which is disposed between the outdoor unit and the plurality of indoor units and converts cooling and heating.

In such the conventional multi-air conditioner system, a means for inputting which indoor unit is connected to each branch hole of a cooling and heating conversion device has been required. Specifically, a rotary switch for inputting the number of branch hole connected to each indoor unit or the number of indoor unit connected to each branch hole has been used as a means for inputting which indoor units is connected to each branch hole.

However, since an installation engineer memorizes the address of an indoor unit connected to each branch hole and manually inputs the address at the time of installing the indoor unit, errors may be caused by falsely inputting the address, or air conditioning may not be performed in the way a user intend. In addition, only one indoor unit may be connected to a single branch hole, and thus a plurality of indoor units are not connected to a single branch hole.

SUMMARY

To address the above-discussed deficiencies, it is a primary object to provide a cooling and heating conversion device for obtaining information of a connected indoor unit without manually setting by a user, a controlling method thereof and an air conditioning system.

According to an exemplary embodiment, there is provided a cooling and heating conversion device including a plurality of branch holes configured to provide refrigerants to indoor units, a plurality of valves configured to respectively correspond to the plurality of branch holes and respectively select refrigerants which respectively correspond to the plurality of branch holes and are to be provided to at least one indoor unit, among different refrigerants provided from an outdoor unit, a plurality of ports configured to respectively correspond to the plurality of branch holes, and a processor configured to, in response to indoor unit information including refrigerant information being input through the plurality of ports, control each of the plurality of valves to provide a refrigerant corresponding to the refrigerant information through a branch hole corresponding to a port to which the refrigerant information is input.

The indoor unit information may include address information of at least one indoor unit corresponding to the port to which the indoor unit information is input.

The indoor unit information may include address information of a plurality of indoor units corresponding to the port to which the indoor unit information is input, and the processor may control each of the plurality of valves to provide the refrigerant corresponding to the refrigerant information to a plurality of indoor units corresponding to the address information of the plurality of indoor units.

The cooling and heating conversion device may further include a storage configured to store the address information of the plurality of indoor units corresponding to the port to which the indoor unit information is input, and the processor may provide a refrigerant through a branch hole corresponding to the port to which the indoor unit information is input, change the stored address information of the plurality of the indoor units to address information of at least one indoor unit in which a temperature change corresponding to the provided refrigerant is detected and store the changed address information.

The processor, in response to indoor unit information including address information of an identical indoor input being input through the plurality of ports, may control each of the plurality of valves to provide the refrigerant corresponding to the refrigerant information to an indoor unit corresponding to the address information of the identical indoor unit through the plurality of branch holes which respectively correspond to the plurality of ports.

The cooling and heating conversion device may further include a storage configured to store address information of an indoor unit corresponding to the plurality of ports to which the indoor unit information is input, and the processor may provide a refrigerant through one of the plurality of branch holes corresponding to the plurality of ports to which the indoor unit information is input, change address information of an indoor unit corresponding to a branch hole which provides the refrigerant to address information of at least one indoor unit in which a temperature change corresponding to the provided refrigerant is detected and store the changed address information.

The plurality of ports may further include a port which receives and transmits information from and to an outdoor unit, and the processor, in response to an operation command being input from the plurality of indoor units, may determine a receiver of the input operation command, in response to the receiver of the operation command being the cooling and heating conversion device, perform an operation corresponding to the input operation command, and in response to the receiver of the operation command being the outdoor unit, transmit the operation command to the outdoor unit.

According to an exemplary embodiment, there is provided a method for controlling a cooling and heating conversion device including receiving different refrigerants from an outdoor unit, and in response to indoor unit information including refrigerant information being input through a plurality of ports which respectively correspond to a plurality of branch holes which provide refrigerants to indoor units, controlling each of a plurality of valves to provide a refrigerant corresponding to the refrigerant information through a branch hole corresponding to a port to which the refrigerant information is input.

The indoor unit information may include address information of at least one indoor unit corresponding to the port to which the indoor unit information is input.

The indoor unit information may include address information of a plurality of indoor units corresponding to the port to which the indoor unit information is input, and the controlling may include controlling each of the plurality of valves to provide the refrigerant corresponding to the refrigerant information to a plurality of indoor units corresponding to the address information of the plurality of indoor units.

The method may further include storing the address information of the plurality of indoor units corresponding to the port to which the indoor unit information in input, providing a refrigerant through a branch hole corresponding to the port to which the indoor unit information is input, and changing the stored address information of the plurality of indoor units to address information of at least one indoor unit in which a temperature change corresponding to the provided refrigerant is detected and storing the changed address information.

The controlling may include in response to indoor unit information including address information of an identical indoor unit being input through the plurality of ports, controlling each of the plurality of valves to provide the refrigerant corresponding to the refrigerant information to an indoor unit corresponding to the address information of the identical indoor unit through the plurality of branch holes which respectively correspond to the plurality of ports.

The method may further include storing address information of an indoor unit corresponding to the plurality of ports to which the indoor unit information is input, providing a refrigerant through one of a plurality of branch holes which respectively correspond to the plurality of ports to which the indoor unit information is input, and changing address information of an indoor unit corresponding to a branch hole which provides the refrigerant to address information of at least one indoor unit in which a temperature change corresponding to the provided refrigerant is detected and storing the changed address information.

The method may further include in response to an operation command being input from the plurality of indoor units, determining a receiver of the input operation command, and in response to the receiver of the operation command being the cooling and heating conversion device, performing an operation corresponding to the input operation command, and in response to the receiver of the operation command being the outdoor unit, transmitting the operation command to the outdoor unit.

According to an exemplary embodiment, there is provided an air conditioning system including a cooling and heating conversion device configured to include a plurality of branch holes, an outdoor unit configured to provide refrigerants to the cooling and heating conversion device, and at least one indoor unit configured to receive the refrigerants through the plurality of branch holes and emit temperature adjusted air, wherein the cooling and heating conversion device, in response to indoor unit information including refrigerant information being received from the at least one indoor unit, provides a refrigerant corresponding to the refrigerant information through a branch hole corresponding to an indoor unit which transmits the indoor unit information.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
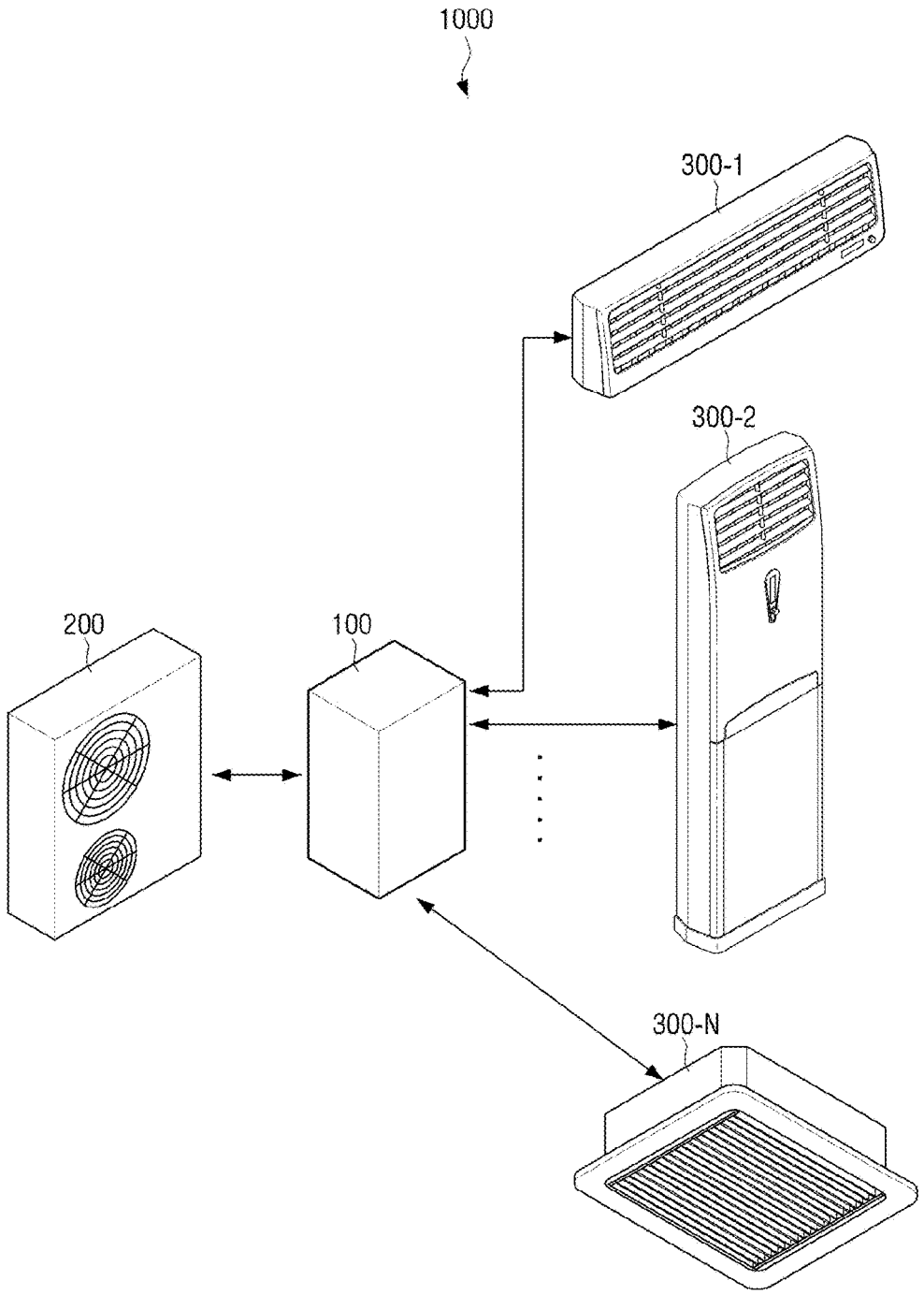
FIG. 1 illustrates an air conditioning system according to an exemplary embodiment.

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, the terms used in exemplary embodiments will be briefly explained, and exemplary embodiments will be described in greater detail with reference to the accompanying drawings.

Terms used in the present disclosure are selected as general terminologies currently widely used in consideration of the configuration and functions of the present disclosure, but can be different depending on intention of those skilled in the art, a precedent, appearance of new technologies, and the like. Further, in specific cases, terms may be arbitrarily selected. In this case, the meaning of the terms will be described in the description of the corresponding embodiments. Accordingly, the terms used in the description should not necessarily be construed as simple names of the terms, but be defined based on meanings of the terms and overall contents of the present disclosure.

The example embodiments may vary, and may be provided in different example embodiments. Various example embodiments will be described with reference to accompanying drawings. However, this is not intended to limit the scope to an exemplary embodiment, and therefore, it should be understood that all the modifications, equivalents or substitutes included under the invented spirit and technical scope are encompassed. In describing the exemplary embodiments, well-known functions or constructions are not described in detail since they would obscure the specification with unnecessary detail.

The terms such as "first," "second," and so on may be used to describe a variety of elements, but the elements should not be limited by these terms. The terms are used simply to distinguish one element from other elements.

Singular forms are intended to include plural forms unless the context clearly indicates otherwise. In the present application, the terms "include" and "comprise" designate the presence of features, numbers, steps, operations, components, elements, or a combination thereof that are written in the specification, but do not exclude the presence or possibility of addition of one or more other features, numbers, steps, operations, components, elements, or a combination thereof.

In an example embodiment, 'a module' or 'a unit' performs at least one function or operation, and may be realized as hardware (e.g., circuitry), firmware, software, or combination thereof. In addition, a plurality of 'modules' or 'units' may be integrated into at least one module and may be realized as at least one processor in an integrated manner except for 'modules' or 'units' that should be realized in specific hardware.

In the example embodiments for the cooling and heating conversion device described below, the cooling and heating conversion device may be composed of a cooling and heating system.

The example embodiments of the disclosure will be described in greater detail below in a manner that will be understood by one of ordinary skill in the art. However, exemplary embodiments may be realized in a variety of different configurations, and not limited to descriptions provided herein. Also, well-known functions or constructions are not described in detail since they would obscure the disclosure with unnecessary detail.

Hereinafter, exemplary embodiments will be described in detail with reference to accompanying drawings.

FIG. 1 illustrates a view of an air conditioning system according to an exemplary embodiment.

Referring to FIG. 1, an air conditioning system 1000 may include a cooling and heating conversion device 100, an outdoor unit 200 and first, second, . . . and nth indoor units 300-1, 300-2, . . . and 300-N.

The cooling and heating conversion device 100 may be disposed between the outdoor unit 200 and the plurality of indoor units 300-1, 300-2, . . . and 300-N and supply refrigerants provided from the outdoor unit 200 to the plurality of indoor units 300-1, 300-2, . . . and 300-N, respectively. Specifically, the cooling and heating conversion device 100 may be provided with different refrigerants from the outdoor unit 200 and respectively supply refrigerants corresponding to operation commands of the plurality of indoor units 300-1, 300-2, . . . and 300-N to the plurality of indoor units 300-1, 300-2, . . . and 300-N. The different refrigerants may refer to low-temperature refrigerants for cooling and high-temperature refrigerants for heating.

In addition, the cooling and heating conversion device 100 may store address information of each of the plurality of indoor units 300-1, 300-2, . . . and 300-N to supply the refrigerants provided from the outdoor unit 200 to the plurality of indoor units 300-1, 300-2, . . . and 300-N, respectively. The address information of the plurality of indoor units 300-1, 300-2, . . . and 300-N may be manually input by a user or may be received through a plurality of communication channels which are connected to the plurality of indoor units 300-1, 300-2, . . . and 300-N, respectively.

The plurality of indoor units 300-1, 300-2, . . . and 300-N may be connected to a single outdoor unit 200. Specifically, the plurality of indoor units 300-1, 300-2, . . . and 300-N may be connected to the outdoor unit 200 to exchange refrigerants with the cooling and heating conversion device interposed therebetween. The cooling and heating conversion device 100, the outdoor unit 200 and the plurality of indoor units 300-1, 300-2, . . . and 300-N may be connected through pipes for exchanging refrigerants.

The plurality of indoor units 300-1, 300-2, . . . and 300-N may receive and transmit information from and to the outdoor unit 200 for performing an air conditioning operation. Specifically, the plurality of indoor units 300-1, 300-2, . . . and 300-N may receive and transmit information from and to the outdoor unit 200 via the cooling and heating conversion device 100.

The plurality of indoor units 300-1, 300-2, . . . and 300-N may perform at least one air conditioning of cooling for lowering indoor air temperature, heating for increasing indoor air temperature, blowing for forming indoor air, dehumidifying for reducing indoor humidity or the like.

The plurality of indoor units 300-1, 300-2, . . . and 300-N may be different types. For example, the first indoor unit 300-1 may be a wall mounted type, the second indoor unit 300-2 may be a stand type, and the nth indoor unit 300-N may be a duct type or a floor type.

The plurality of indoor units 300-1, 300-2, . . . and 300-N may operate independently. Specifically, the plurality of indoor units 300-1, 300-2, . . . and 300-N may perform cooling and heating operations different from one another. For example, the first indoor unit 300-1 may perform a cooling operation and the second indoor unit 300-2 may perform a heating operation at the same time.

The outdoor unit 200 may exchange heat with outdoor air. Specifically, the outdoor unit 200 may exchange heat with outdoor air through a cooling cycle to emit the heat transmitted through a refrigerant of at least one of the plurality of indoor units 300-1, 300-2, . . . and 300-N to an outside, or through a heating cycle to absorb the heat deprived of from the refrigerant from the outside.

In FIG. 1, it is illustrated that three indoor units are connected to a single outdoor unit, but when embodying the disclosure, two indoor units may be connected to the single outdoor unit, or four or more indoor units may be connected to the single outdoor unit. In addition, in an exemplary embodiment, it is illustrated that a single outdoor unit is connected to a plurality of indoor units, but when embodying the disclosure, a plurality of indoor units may be connected to a plurality of indoor units.

As described above, addresses of a plurality of indoor units connected to a cooling and heating conversion device may be directly received and set from the plurality of indoor units, so that the occurrence of errors caused by falsely inputting address information and the risk of malfunction would be reduced.

Figure 2:
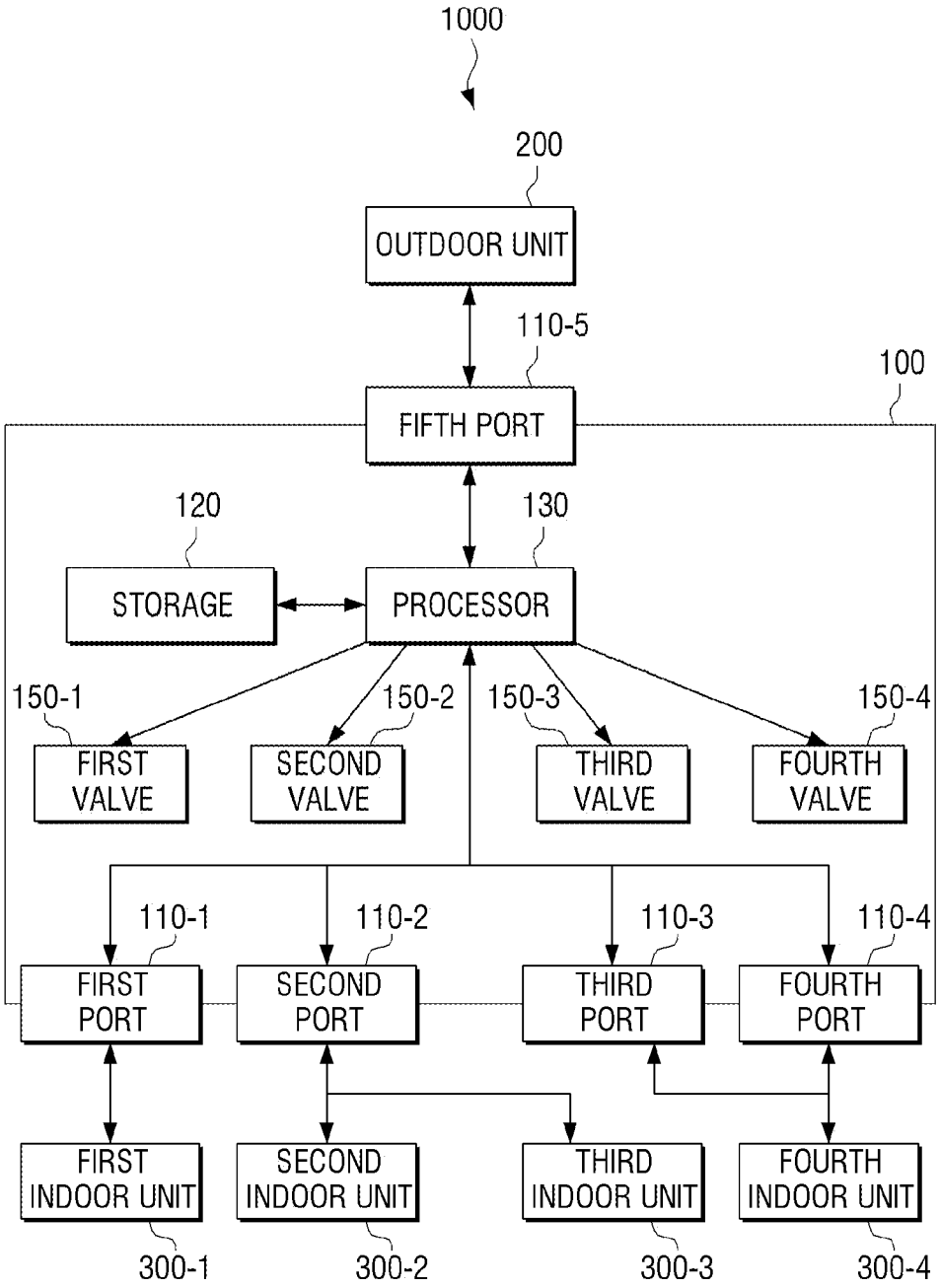
FIG. 2 illustrates a schematic view of a communication connection structure of an air conditioning system according to an exemplary embodiment.

FIG. 2 illustrates a schematic view of a communication connection structure of an air conditioning system according to an exemplary embodiment. FIG. 2 does not illustrate a refrigerant pipe connection structure of an air conditioning system according to an exemplary embodiment of the present disclosure, but it will be described in detail with reference to FIG. 3.

Referring to FIG. 2, the air conditioning system 1000 may include the cooling and heating conversion device 100, the outdoor unit 200 and a plurality of indoor units 300-1, 300-2, 300-3 and 300-4.

Configurations and operations of the outdoor unit 200 and the plurality of indoor units 300-1, 300-2, 300-3 and 300-4 in FIG. 2 are the same as those of the outdoor unit and the plurality of indoor units described in FIG. 1, and thus the repeated description will be omitted.

The cooling and heating conversion device 100 may include first, second, third, fourth and fifth ports 110-1, 110-2, 110-3, 110-4 and 110-5, a storage 120, a processor 130 and first, second, third and fourth valves 150-1, 150-2, 150-3 and 150-4.

The plurality of ports 110-1, 110-2, 110-3, 110-4 and 110-5 may be constituents for communicating with the plurality of indoor units 300-1, 300-2, 300-3 and 300-4 and the outdoor unit 200. Specifically, the plurality of ports 110-1, 110-2, 110-3, 110-4 and 110-5 may be connected to the plurality of indoor units 300-1, 300-2, 300-3 and 300-4 and the outdoor unit 200 through cables, etc. and receive and transmit information from and to the plurality of indoor units 300-1, 300-2, 300-3 and 300-4 and the outdoor unit 200.

Specifically, the first, second, third and fourth ports 110-1, 110-2, 110-3 and 110-4 may be connected to the plurality of indoor units 300-1, 300-2, 300-3 and 300-4 and transmit and receive information to and from the plurality of indoor units 300-1, 300-2, 300-3 and 300-4. The first, second, third and fourth ports 110-1, 110-2, 110-3 and 110-4 may respectively correspond to a plurality of branch holes (not shown) which provide refrigerants to the plurality of indoor units 300-1, 300-2, 300-3 and 300-4.

For example, when a refrigerant is provided to the first indoor unit 300-1 through a first branch hole (not shown), among the plurality of branch holes of the cooling and heating conversion device 100, the first indoor unit 300-1 may be connected to the first port 110-1 corresponding to the first branch hole through a communication cable. When a refrigerant is provided to the second indoor unit 300-2 and the third indoor unit 300-3 through a second branch hole (not shown), among the plurality of branch holes of the cooling and heating conversion device 100, the second indoor unit 300-2 and the third indoor unit 300-3 may be connected to the second port 110-2 corresponding to the second branch hole through a communication cable. When a refrigerant is provided to the fourth indoor unit 300-4 through a third branch hole (not shown) and a fourth branch hole (not shown), among the plurality of branch holes of the cooling and heating conversion device 100, the fourth indoor unit 300-4 may be connected to the third port 110-3 and the fourth port 110-4 corresponding to the third branch hole and the fourth branch hole.

The first, second, third and fourth ports 110-1, 110-2, 110-3 and 110-4 may receive indoor unit information from the plurality of indoor units 300-1, 300-2, 300-3 and 300-4, respectively. Specifically, the respective indoor unit information received from the plurality of indoor units 300-1, 300-2, 300-3 and 300-4 may include refrigerant information according to the operation of each indoor unit, address information of the indoor unit, an operation command, etc. The refrigerant information may refer to a low-temperature refrigerant or a high-temperature refrigerant depending on whether an indoor unit performs a cooling operation or a heating operation.

The fifth port 110-5 may be connected to the outdoor unit 200 and receive and transmit information from and to the outdoor unit 200. The fifth port 110-5 may receive outdoor unit information from the outdoor unit 200. The fifth port 110-5 may provide the indoor unit information received from the plurality of indoor units 300-1, 300-2, 300-3 and 300-4 to the outdoor unit 200.

The fifth port 110-5 may be separated from the first, second, third and fourth ports 110-1, 110-2, 110-3 and 110-4 connected to the plurality of indoor units 300-1, 300-2, 300-3 and 300-4, and information received through the fifth port 110-5 may not include the indoor unit information of the plurality of indoor units 300-1, 300-2, 300-3 and 300-4.

As a different exemplary embodiment from that shown in FIG. 2, the fifth port 110-5 connected to the outdoor unit 200 may receive information of the plurality of indoor units connected to the cooling and heating conversion device 100. In such a case, the plurality of indoor units 300-1, 300-2, 300-3 and 300-4 may not communicate with the cooling and heating conversion device 100 through the first, second, third and fourth ports 110-1, 110-2, 110-3 and 110-4, but directly communicate with the outdoor unit 200. The cooling and heating conversion device 100 may receive the address information of the plurality of indoor units 300-1, 300-2, 300-3 and 300-4 by using rotary switches (not shown) which respectively correspond to the plurality of branch holes (not shown). The detailed process of setting address information will be described below with reference to FIG. 5.

The storage 120 may store various programs and data for performing a function of the cooling and heating conversion device 100. Specifically the storage 120 may store the information of the plurality of indoor units 300-1, 300-2, 300-3 and 300-4 received through the first, second, third and fourth ports 110-1, 110-2, 110-3 and 110-4. The storage 120 may store the address information of the plurality of indoor units 300-1, 300-2, 300-3 and 300-4 received through the plurality of indoor units 300-1, 300-2, 300-3 and 300-4. The storage 120 may store indoor unit connection structure for each branch hole detected based on the received indoor unit address information.

The storage 120 may store information of a valve corresponding to each branch hole.

The plurality of valves 150-1, 150-2, 150-3 and 150-4 may respectively correspond to the plurality of branch holes (not shown), and select a refrigerant to be provided to a corresponding indoor unit, among different refrigerants provided from the outdoor unit 200.

The processor 130 may control each element of the cooling and heating conversion device 100. Specifically, the processor 130 may control each element of the cooling and heating conversion device 100 based on the information received through the plurality of ports 110-1, 110-2, 110-3, 110-4 and 110-5. The processor 130 may be a Micro Controller Unit (MCU).

When indoor unit information including refrigerant information is input through at least one of the first, second, third and fourth ports 110-1, 110-2, 110-3 and 110-4, the processor 130 may control each of the plurality of valves 150-1, 150-2, 150-3 and 150-4 to provide a refrigerant corresponding to the refrigerant information through a branch hole corresponding to at least one port to which the refrigerant information is input.

The processor 130 may identify and store the indoor unit connection structure of each branch hole based on the received indoor unit address information in the storage 120.

Specifically, the processor 130, in response to address information of the plurality of indoor units being received through a single port, may match and store a branch hole corresponding to the port to which the indoor unit information is input with the plurality of indoor unit corresponding to the received indoor unit address information. In addition, the processor 130 may control each of the plurality of valves 150-1, 150-2, 150-3 and 150-4 to provide a refrigerant corresponding to the refrigerant information included in the received indoor unit information to a plurality of matched indoor units.

When the stored information of the plurality of indoor units which are matched with the branch hole is different from an actual connection structure, the processor 130 may change the stored information of the plurality of indoor units.

Specifically, the processor 130 may provide a refrigerant to the plurality of indoor units which are matched with the branch hole corresponding to the port to which the indoor unit information is input, when temperature change of the plurality of indoor units which are matched with the branch hole in which the refrigerant is provided does not correspond to temperature change corresponding to the provided refrigerant, information of the plurality of indoor units which are matched with the branch hole in which the refrigerant is provided may be changed to information of at least one indoor unit where the temperature change corresponding to the provided refrigerant is detected, among all the indoor units connected to the cooling and heating conversion device 100.

In addition, the processor 130, in response to address information of an identical indoor unit being received through the plurality of ports, may match and store a plurality of branch holes which respectively correspond to a plurality of ports to which the indoor unit information is input with indoor units corresponding to the received indoor unit address information, respectively. The processor 130 may control each of the plurality of valves 150-1, 150-2, 150-3 and 150-4 to provide a refrigerant corresponding to the refrigerant information included in the received indoor unit information to the matched indoor unit.

When the stored indoor unit information which are respectively matched with the plurality of branch holes is different from an actual connection structure, the processor 130 may change the stored indoor unit information.

Specifically, the processor 130 may provide a refrigerant to the matched indoor unit through one of the plurality of branch holes which respectively correspond to the plurality of ports to which the indoor unit information is input, and when temperature change of the indoor unit which is matched with the branch hole to which the refrigerant is provided does not correspond to temperature change corresponding to the provided refrigerant, the processor 130 may change the stored information of the indoor unit which is matched with the branch hole to which the refrigerant is provided to information of at least one indoor unit where the temperature change corresponding to the provided refrigerant is detected, among all the indoor units connected to the cooling and heating conversion device 100.

The processor 130 may perform the identical operation regarding another branch hole, among the plurality of branch holes which respectively correspond to the plurality of ports to which the indoor unit information is input.

When commands and the data are include in the indoor unit information received through the plurality of ports which are connected to the plurality of indoor units, the processor 130 may determine receivers of the commands and the data. Specifically, when the receiver of a command and data received from an indoor unit is determined to be the cooling and heating conversion device 100, the processor 130 may perform an operation corresponding to the command or store the received data When it is determined that the receiver of the command and data received from an indoor unit is the outdoor unit 200, the received indoor unit information or the command and data included in the indoor unit information may be transmitted to the outdoor unit 200 through the fifth port 110-5 connected to the outdoor unit 200.

The number of indoor units, ports and valves and the connection structures of the indoor units may not limited to FIG. 2, but may vary.

As described above, addresses of a plurality of indoor units connected to a cooling and heating conversion device may be directly received and set from the plurality of indoor units, so that the occurrence of errors caused by falsely inputting address information and the risk of malfunction would be reduced.

After identifying the connection structures of the plurality of branch holes of the cooling and heating conversion device 100 and the plurality of indoor units 300-1, 300-2, 300-3 and 300-4 by using the indoor unit address information input through the plurality of ports and confirming whether the connection structures correspond to actual connection structures by providing refrigerants to the plurality of branch holes, respectively, a more specific connection structure may be identified.

Figure 3:
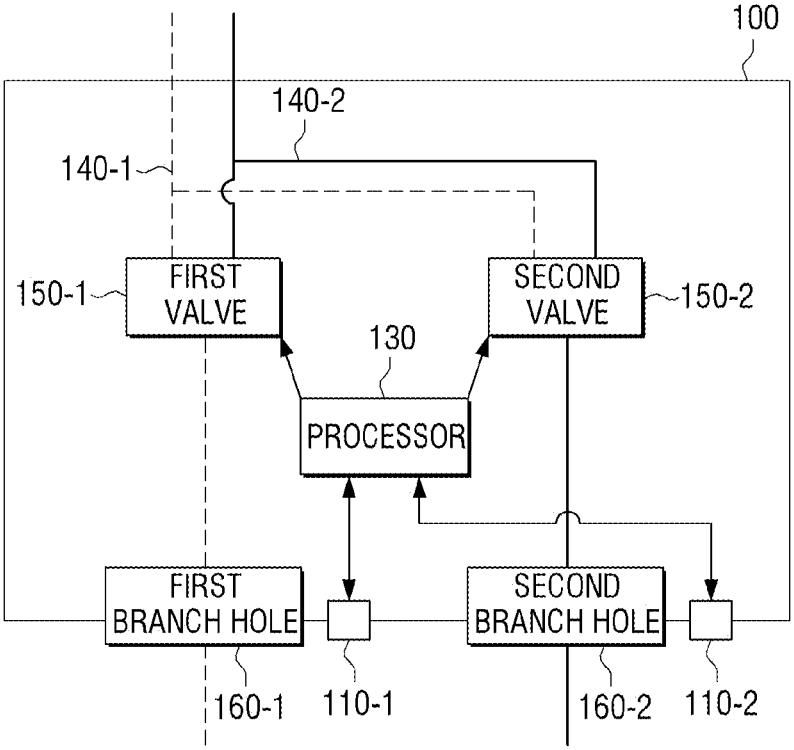
FIG. 3 illustrates a schematic view of a cooling and heating conversion device according to an exemplary embodiment.

FIG. 3 illustrates a schematic view of a cooling and heating conversion device according to an exemplary embodiment. Specifically, FIG. 3 is a schematic view illustrating a refrigerant pipe structure of a cooling and heating conversion unit according an exemplary embodiment of the present disclosure.

Referring to FIG. 3, the cooling and heating conversion device 100 may include the first and second ports 110-1 and 110-2, the processor 130, a plurality of refrigerant pipes 140-1 and 140-2, the first and second valves 150-1 and 150-2 and first and second branch holes 160-1 and 160-2.

For convenience of explanation, valves, branch holes and ports are illustrated in two, but when embodying the present disclosure, it may be one or three or more.

The plurality of branch holes 160-1 and 160-2 may be elements for providing refrigerants to the indoor units. A branch hole may refer to an area where a refrigerant pipe for providing a refrigerant to an indoor unit passes through on one side of the case constituting the cooling and heating conversion device 100.

The plurality of ports 110-1 and 110-2 may respectively correspond to the plurality of branch holes 160-1 and 160-2, be connected to the plurality of indoor units through cables, and transmit and receive information to and from the plurality of indoor units. For example, when a first indoor unit (not shown) is supplied with a refrigerant from the cooling and heating conversion device 100 through the first branch hole 160-1, the first indoor unit may communicate with the cooling and heating conversion device 100 through the first port 110-1 corresponding to the first branch hole 160-1.

The processor 130 may match the first branch hole 160-1 with the first indoor unit based on information of the first unit received through the first port 110-1, and based on the refrigerant information included in the received indoor unit information, control the first valve 150-1 corresponding to the first branch hole 160-1. The cooling and heating conversion device 100 may receive different refrigerants from an outdoor unit (not shown) through the plurality of refrigerant pipes 140-1 and 140-2, respectively. For example, the cooling and heating conversion device 100 may be supplied with a low-temperature refrigerant for cooling through a low-temperature pipe 140-1, and a high-temperature refrigerant for heating through a high-temperature pipe 140-2 from the outdoor unit.

For example, when indoor unit information of the first indoor unit includes refrigerant information for performing a cooling operation, the processor 130 may control the first valve 150-1 corresponding to the first branch hole 160-1 to select a low-temperature refrigerant corresponding to the refrigerant information of a low-temperature refrigerant provided through the low-temperature pipe 140-1 and a high-temperature refrigerant provided through the high temperature pipe 140-2. Accordingly, the selected low-temperature refrigerant may be supplied to the first indoor unit through the first branch hole 160-1.

When indoor unit information of a second indoor unit (not shown) includes refrigerant information for performing a heating operation, the processor 130 may control the second valve 150-2 corresponding to the second branch hole 160-2 to select a high-temperature refrigerant corresponding to the refrigerant information of the low-temperature refrigerant provided through the low-temperature pipe 140-1 and the high-temperature refrigerant provided through the high-temperature pipe 140-2. Accordingly, the selected high-temperature refrigerant may be supplied to the second indoor unit through the second branch hole 160-2.

The plurality of ports 110-1 and 110-2, the processor 130 and the plurality of valves 150-1 and 150-2 of FIG. 3 are the same as those shown in FIG. 2, and thus repeated description will be omitted.

As described above, addresses of a plurality of indoor units connected to a cooling and heating conversion device may be directly received and set from the plurality of indoor units, so that the occurrence of errors caused by falsely inputting address information and the risk of malfunction would be reduced.

Figure 4:
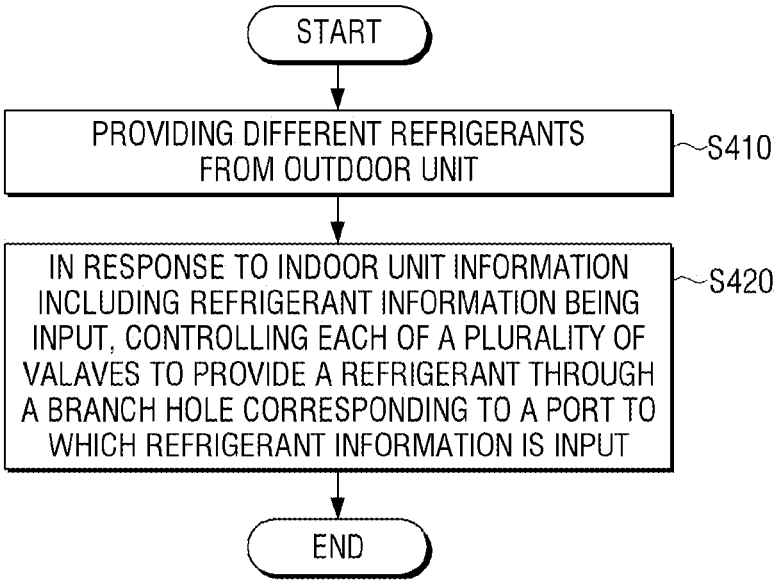
FIG. 4 illustrates a flow chart provided to explain a controlling method of a cooling and heating conversion device according to an exemplary embodiment.

FIG. 4 illustrates a flow chart provided to explain a controlling method of a cooling and heating conversion device according to an exemplary embodiment.

Referring to FIG. 4, a cooling and heating conversion device may be supplied with different refrigerants from an outdoor unit (S410). The different refrigerants may be low-temperature refrigerants for cooling and high-temperature refrigerants for heating.

The cooling and heating conversion device, in response to indoor unit information including refrigerant information being input, may control each of a plurality of valves to provide a refrigerant through a branch hole corresponding to a port to which the refrigerant information is input (S420).

The cooling and heating conversion device may include a plurality of branch holes configured to provide refrigerants to indoor units and a plurality of port which respectively correspond to the plurality of branch holes. Each of the plurality of ports may be connected to the communication cable of at least one indoor unit.

Since the plurality of ports correspond to the plurality of branch holes, the cooling and heating conversion device may match and store an indoor unit connected to a port with a branch hole corresponding to the port connected to the indoor unit. The cooling and heating device may receive indoor unit address information from an indoor unit through a port and match and store a branch hole corresponding to the port with the indoor unit.

Specifically, the cooling and heating conversion device, in response to the indoor unit information including the refrigerant information being input through a port, may provide a selected refrigerant through a branch hole corresponding to the port to which the indoor unit information is input. The cooling and heating conversion device may control a valve corresponding to the branch hole for selecting a refrigerant corresponding to the refrigerant information of a high-temperature refrigerant and a low-temperature refrigerant received from the outdoor unit.

The cooling and heating conversion device, in response to information of a plurality of indoor units being input through a plurality of port, may control a plurality of valves which respectively correspond to a plurality of ports to which the indoor unit information is input.

As described above, addresses of a plurality of indoor units connected to a cooling and heating conversion device may be directly received and set from the plurality of indoor units, so that the occurrence of errors caused by falsely inputting address information and the risk of malfunction would be reduced.

Figure 5:
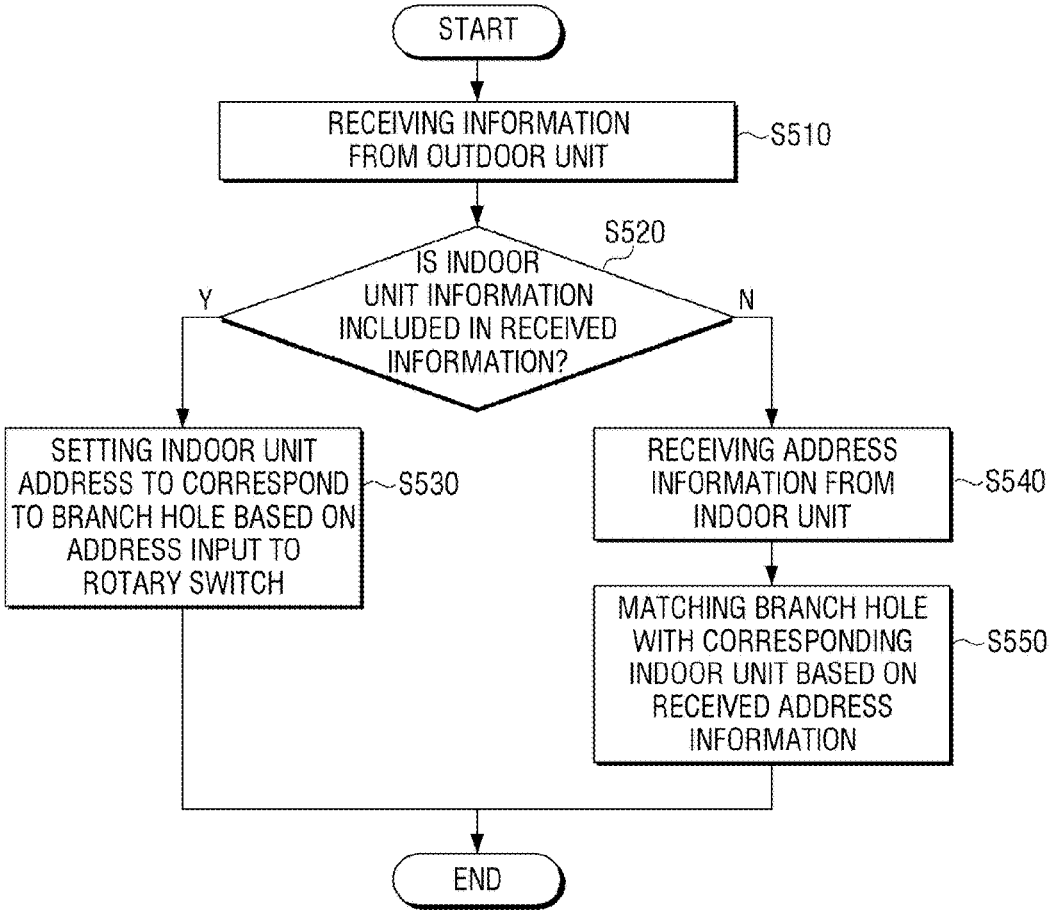
FIG. 5 illustrates a flow chart provided to explain a process of setting addresses of indoor units of a cooling and heating conversion device according to an exemplary embodiment.

FIG. 5 illustrates a flow chart provided to explain a process of setting addresses of indoor units of a cooling and heating conversion device according to an exemplary embodiment.

Referring to FIG. 5, a cooling and heating conversion device may receive information from an outdoor unit (S510). Specifically, when power is supplied to the cooling and heating conversion device, the cooling and heating conversion device may receive information from the outdoor unit.

The cooling and heating conversion device may determine whether indoor unit information is included in the information received from the outdoor unit (S520). Specifically, the cooling and heating conversion device may determine whether the indoor unit information is included in the information received from the outdoor unit to confirm whether a communication cable of an indoor unit is connected to the outdoor unit or to the cooling and heating conversion device.

When it is determined that the information received from the outdoor unit includes the indoor unit information (S520-Y), the cooling and heating conversion device may set the address of an indoor unit corresponding to a branch hole based on the address input to a rotary switch (S530). Specifically, when the indoor unit information is included in the address received from the outdoor unit, the cooling and heating conversion device may determine that the communication cable of the indoor unit is connected to the outdoor unit and set the address of the indoor unit corresponding to the branch hole based on the address input to the rotary switch. The address input to the rotary switch may be manually input by an installation engineer, etc. at the time of installing an indoor unit.

When it is determined that the indoor unit information is not included in the information received from the outdoor unit (S520-N), the cooling and heating conversion device may receive address information of indoor units (S540). Specifically, when the indoor unit information is not included in the information received from the outdoor unit, the cooling and heating conversion device may determine that the communication cable of the indoor unit is connected to a port provided in the cooling and heating conversion device and receive the address information from indoor unit.

The cooling and heating conversion device may match an indoor unit with corresponding branch hole based on the received address information (S550).

As described above, setting of the addresses of indoor units may vary depending on the information received from an outdoor unit, so that the identical cooling and heating conversion device may be used without changing communication connection structures, even when the communication connection structures of indoor units are different, thereby improving user convenience.

Figure 6:
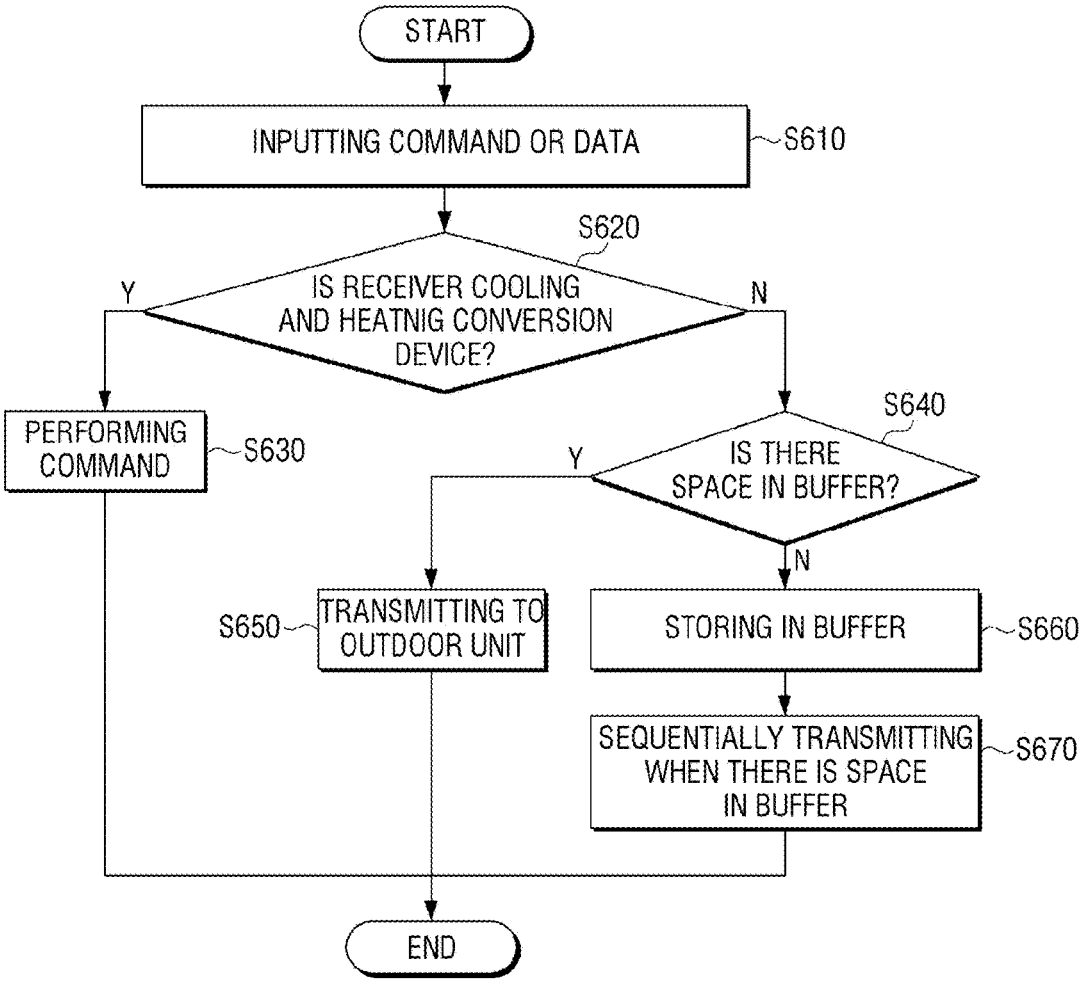
FIG. 6 illustrates a flow chart provided to explain a process of bypass communication of a cooling and heating conversion device according to an exemplary embodiment.

FIG. 6 illustrates a flow chart provided to explain a process of bypass communication of a cooling and heating conversion device according to an exemplary embodiment. Specifically, bypass communication may refer to indirectly transmitting a signal, and according to an exemplary embodiment of the present disclosure, an indoor unit and an outdoor unit may not directly communicate with each other, but communicate with each other via a cooling and heating conversion device, and this will be referred to as the bypass communication.

The cooling and heating conversion device may receive a command or data from an indoor unit (S610). Specifically, the cooling and heating conversion device may receive the command or the data from the indoor unit through a port included in the cooling and heating conversion device.

The cooling and heating conversion device may determine whether a receiver of the command or the data is the cooling and heating conversion device (S620).

When it is determined that the receiver of the command or the data is the cooling and heating conversion device (S620-Y), the cooling and heating conversion device may perform an operation corresponding to the command or the data (S630). For example, when an input command is a command for setting an operation mode or controlling a valve of the cooling and heating conversion device, the cooling and heating conversion device may perform an operation corresponding to the input command, perform an operation by using input data, or store the input data.

When it is determined that the receiver of the input command or the data is the outdoor unit (S620-N), the cooling and heating conversion device may determine whether there is a space in a buffer (S640). The buffer may be allocated for each port which is connected an indoor unit, or may be used integrally without being allocated.

When it is determined that there is a space in the buffer (S640-Y), the cooling and heating conversion device may transmit the received command or data to the outdoor unit by using the buffer (S650). Specifically, the cooling and heating conversion device may transmit the command or data received through the port which is connected to the outdoor unit to the outdoor unit.

When it is determined that there is no space in the buffer (S640-N), the cooling and heating conversion device may store the input command or the data in the buffer (S660). The cooling and heating conversion device may sequentially transmit the stored command and data to the outdoor unit by using the buffer when there is a space in the buffer (S670).

As described above, communication between an outdoor unit and indoor units may be established with the cooling and heating conversion device interposed therebetween by detecting the receiver of the input command or data and performing different operations.

Figure 7:
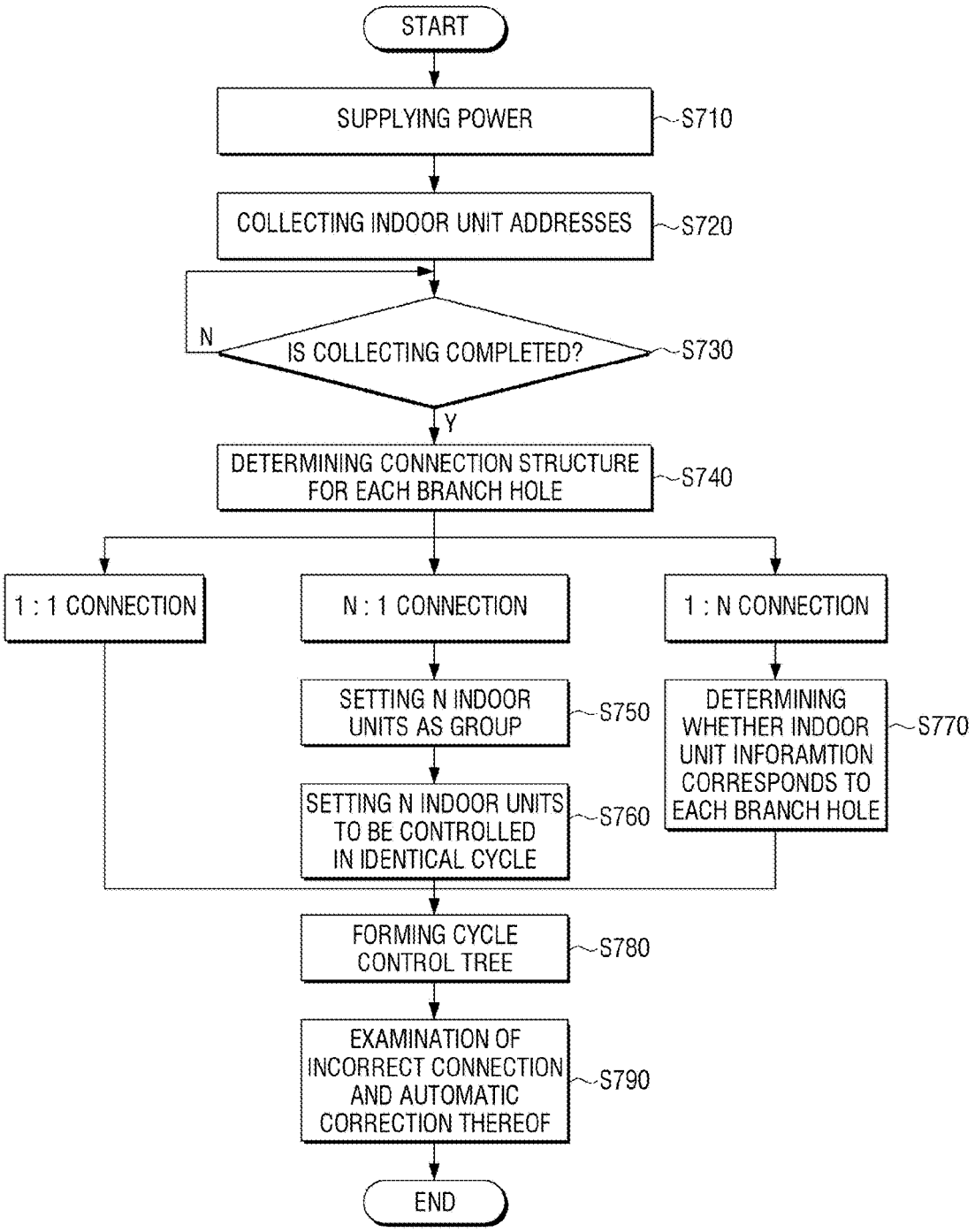
FIG. 7 illustrates a flow chart provided to explain a process of forming a cycle control tree of an air conditioning system according to an exemplary embodiment.

FIG. 7 illustrates a flow chart provided to explain a process of forming a cycle control tree of an air conditioning system according to an exemplary embodiment.

Referring to FIG. 7, a cooling and heating conversion device may be supplied with power (S710). The cooling and heating conversion device may collect addresses of connected indoor units (S720). Specifically, the cooling and heating conversion device may collect the addresses of the indoor units through ports.

When collecting the addresses of the indoor units is not completed (S730-N), the cooling and heating conversion device may repeat collecting the addresses of the indoor units, and when collecting the addresses of the indoor units is completed (S730-Y), an indoor unit connection structure for each branch hole is determined (S740). For example, the cooling and heating conversion device may determine the indoor unit connection structure for each branch hole based on the address information of the indoor units which are input through the ports. For example, an indoor unit address which is input through a single port includes a plurality of addresses, the cooling and heating conversion device may determine an N:1 connection where a single branch hole corresponding to the port is connected to a plurality of indoor units. In addition, when the addresses of indoor units input through a plurality of ports are identical to each other, the cooling and heating conversion device may determine a 1:N connection where a plurality of branch holes which respectively correspond to the plurality of ports are connected to a signal indoor unit. The 1:N connection may be used for providing a refrigerant through a plurality of branch holes for covering capacity of the refrigerant when the capacity of the refrigerant used in the indoor unit is large. When the address of a single address unit is input to a single port, and addresses of different indoor units are input to a plurality of ports, it is determined to be a 1:1 connection where one branch hole is matched with a single indoor unit.

In the case of the N:1 connection where a single branch hole is matched with a plurality of indoor units, the cooling and heating conversion device may set N indoor units which are matched with the single branch hole as a group (S750). The cooling and heating conversion device may set the N indoor units to be controlled in an identical cycle (S760). This is because the identical refrigerant is provided to the N indoor units through the single branch hole to prevent occurrence of errors with different refrigerant information of the N indoor units.

In the case of the 1:N connection where a plurality of branch holes are matched with an identical indoor unit, the cooling and heating conversion device may determine whether information of the indoor unit for each branch hole is identical (S770). Specifically, when the identical indoor unit is matched, indoor unit information including refrigerant information, etc. may be identical, so that the cooling and heating conversion device may determine whether indoor unit information input through a port corresponding to each branch hole is identical. Although the plurality of branch holes are matched with the identical indoor unit, when the indoor unit information for each branch hole is not identical, the indoor unit information matched with the single branch hole may be changed to correspond to indoor unit information matched with another branch hole.

The cooling and heating conversion device may form a cycle control tree (S780). Specifically, the cooling and heating conversion device may determine the indoor unit connection structure of all the connected branch holes and form the cycle control tree. The cycle control tree may be kind of design chart which presents the number of indoor units which are matched with each branch hole, information of the provided refrigerant, the connection structure, etc.

The cooling and heating conversion device may examine an incorrect connection and perform automatic correction thereof based on the formed cycle control tree (S790). The process of examination of the incorrect connection and automatic correction thereof will be described in detail with reference to FIG. 8 below.

Figure 8:
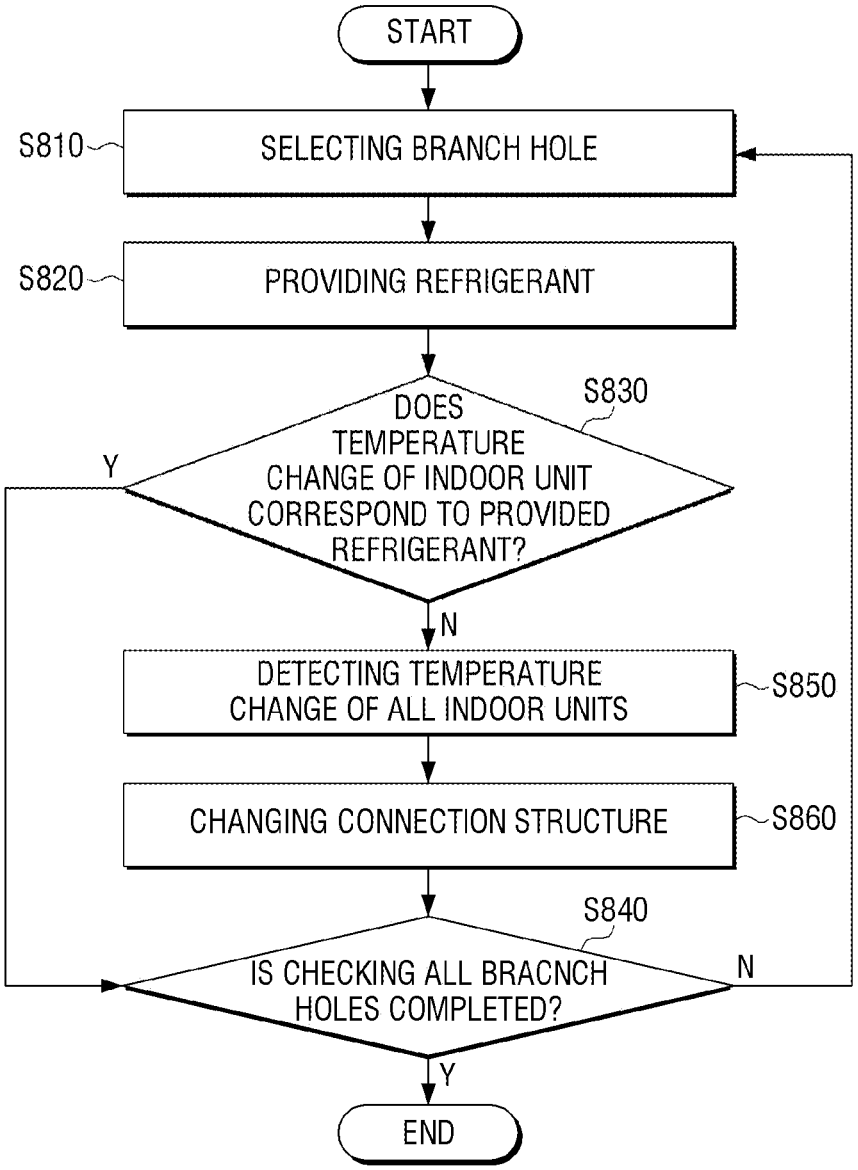
FIG. 8 illustrates a flow chart provided to explain a process of correcting a cycle control tree of an air conditioning system according to an exemplary embodiment.

FIG. 8 illustrates a flow chart provided to explain a process of examining an incorrect connection of a cycle control tree of an air conditioning system and correcting thereof according to an exemplary embodiment The cooling and heating conversion device may select a branch hole for examining a connection, among a plurality of branch holes (S810).

The cooling and heating conversion device may provide a refrigerant through the selected branch hole (S820). The provided refrigerant may be determined based on refrigerant information included in indoor unit information which is matched with the branch hole.

The cooling and heating conversion device may determine whether temperature change of the indoor unit which is matched with the selected branch hole corresponds to the provided refrigerant (S830). Specifically, the cooling and heating conversion device may determine whether the temperature change corresponds to the provided refrigerant by detecting the temperature of the matched indoor unit becomes lower or higher.

When the indoor unit connection structure of the selected branch hole is the N:1 connection, whether the selected branch hole is actually connected to the plurality of matched indoor units by detecting the temperature change of the plurality of indoor units which are matched with the selected branch hole.

When the indoor unit connection structure of the selected branch hole is the 1:1 connection or the 1:N connection, whether the selected branch hole is actually connected to the matched indoor unit by detecting the temperature change of the indoor unit which is matched with the selected branch hole.

When a refrigerant provided through the selected branch hole corresponds to the temperature change of the indoor unit which is matched with the selected branch hole (S830-Y), the cooling and heating conversion device may determine whether the connection structures of all the branch holes provided in the cooling and heating conversion device are checked (S840).

When the refrigerant provided through the selected branch hole does not correspond to the temperature change of the indoor unit which is matched with the selected branch hole (S830-N), the cooling and heating conversion device may detect the temperature change of all the indoor units connected to the cooling and heating conversion device (S850), and determine whether there is an indoor unit in which the temperature change corresponding to the provided refrigerant occurs.

When there is another indoor unit in which the temperature change corresponding to the provided refrigerant occurs, the cooling and heating conversion device may change a connection structure by matching the selected branch hole with information of another indoor unit (S860). Therefore, a communication connection may be changed according to an actual pipe connection.

After changing the connection structure, the cooling and heating conversion device may determine whether the connection structures of all the branch holes provided in the cooling and heating conversion device are checked (S840). When all the connection structures of all the branch holes are checked (S840-Y), the cooling and heating conversion device may complete the examination of the incorrect connection and the automatic correction and perform a normal air conditioning operation, and when all the connection structure of the branch holes are not checked (S840-N), the cooling and heating conversion device may return to the step of selecting a branch hole (S810), select another branch hole and repeatedly perform the identical operations.

As described above, addresses of a plurality of indoor units connected to a cooling and heating conversion device may be directly received and set from the plurality of indoor units, and a connection structure is determined, examined and corrected, so that the occurrence of errors caused by falsely inputting address information and the risk of malfunction would be reduced.

Various exemplary embodiments described above may be embodied in a recording medium that may be read by a computer or a similar apparatus to the computer by using software, hardware, or a combination thereof. According to the hardware embodiment, exemplary embodiments that are described in the present disclosure may be embodied by using at least one selected from Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, electrical units for performing other functions. Exemplary embodiments described in the specification may be embodied as the processor 130 itself in some cases. In a software configuration, various embodiments described in the specification such as a procedure and a function may be embodied as separate software modules. The software modules may respectively perform one or more functions and operations described in the present specification.

Methods of controlling a display apparatus according to various exemplary embodiments may be stored on a non-transitory readable medium. The non-transitory readable medium may be installed and used in various devices.

The non-transitory computer readable recording medium refers to a medium that stores data and that can be read by devices. Specifically, programs of performing the above-described various methods can be stored in a non-transitory computer readable medium such as a CD, a DVD, a hard disk, a Blu-ray disk, universal serial bus (USB), a memory card, ROM, or the like, and can be provided.

Although the present disclosure has been described with an exemplary embodiment, various changes and modifications may be suggested to one skilled in the art. It is intended that the present disclosure encompass such changes and modifications as fall within the scope of the appended claims

What is claimed is:

1. A cooling and heating system, comprising:

a plurality of valves connected to an outdoor unit that stores a plurality types of refrigerants;

a plurality of branch holes respectively corresponding to the plurality of valves and respectively connected to a plurality of indoor units;

a plurality of ports respectively corresponding to the plurality of branch holes; and one or more processors configured to:

receive indoor unit information from one of the plurality of ports, wherein the indoor unit information includes refrigerant information, determine a type of refrigerant based on the received indoor unit information, and control at least one of the plurality of valves to provide the determined type of refrigerant to at least one of the plurality of branch holes corresponding to the at least one of the plurality of valves.

2. The system of claim 1, wherein the indoor unit information comprises address information of at least one indoor unit, and wherein the at least one indoor unit is corresponding to the one of the plurality of ports.

3. The system of claim 2, wherein the indoor unit information comprises address information of a plurality of indoor units, wherein the plurality of indoor units are corresponding to the one of the plurality of ports, and wherein the processor is further configured to control each of the plurality of valves to provide the refrigerant corresponding to the refrigerant information to the plurality of indoor units.

4. The system of claim 3, further comprising:

a storage configured to store the address information of the plurality of indoor units corresponding to the one of the plurality of ports, wherein the processor is further configured to:

provide the refrigerant through a branch hole corresponding to the one of the plurality of ports, change the stored address information of the plurality of the indoor units to address information of at least one indoor unit that a temperature change, which is corresponding to the provided refrigerant, is detected, and store the changed address information of the at least one indoor unit.

5. The system of claim 2, wherein the processor is further configured to, in response to the indoor unit information, including a same address information of an indoor unit, being input through the plurality of ports, controls each of the plurality of valves to provide the refrigerant corresponding to the refrigerant information to the indoor unit through the plurality of branch holes corresponding to the plurality of ports.

6. The system of claim 5, further comprising:

a storage configured to store the same address information of an indoor unit corresponding to the plurality of ports, wherein the processor is further configured to provide a refrigerant through one of the plurality of branch holes corresponding to the plurality of ports that the indoor unit information is input, change the address information of an indoor unit corresponding to a branch hole that provides the refrigerant, to address information of at least one indoor unit that a temperature change, corresponding to the provided refrigerant, is detected, and store the changed address information of the at least one indoor unit.

7. The system of claim 1, wherein the plurality of ports further comprise a port that receives and transmits information from and to the outdoor unit, and wherein the processor is further configured to:

in response to an operation command being input from the plurality of indoor units, determine a receiver of the input operation command, in response to the receiver of the operation command being the cooling and heating conversion system, perform an operation corresponding to the input operation command, and in response to the receiver of the operation command being the outdoor unit, transmits the operation command to the outdoor unit.

8. A method of controlling a cooling and heating system, the method comprising:

receiving a plurality types of refrigerants from an outdoor unit; and in response to an input, through one of a plurality of ports, that comprises an indoor unit information including refrigerant information, controlling at least one of a plurality of valves to provide a refrigerant corresponding to the refrigerant information through a branch hole of a plurality of branch holes corresponding to the at least one of the plurality of valves.

9. The method of claim 8, wherein the indoor unit information comprises address information of at least one indoor unit corresponding to the one of the plurality of ports.

10. The method of claim 9, wherein the indoor unit information comprises address information of a plurality of indoor units corresponding to the one of the plurality of ports, and further comprises controlling each of the plurality of valves to provide the refrigerant corresponding to the refrigerant information to the plurality of indoor units.

11. The method of claim 10, further comprising:

storing the address information of the plurality of indoor units corresponding to the one of the plurality of ports;

providing the refrigerant through a branch hole corresponding to the one of the plurality of ports;

changing the stored address information of the plurality of indoor units to address information of at least one indoor unit that a temperature change, corresponding to the provided refrigerant, is detected; and storing the changed address information of the at least one indoor unit.

12. The method of claim 9, further comprising:

in response to the indoor unit information, including a same address information of an indoor unit, being input through the plurality of ports, controlling each of the plurality of valves to provide the refrigerant corresponding to the refrigerant information to the indoor unit through the plurality of branch holes corresponding to the plurality of ports.

13. The method of claim 12, further comprising:

storing the same address information of an indoor unit corresponding to the plurality of ports;

providing a refrigerant through one of a plurality of branch holes corresponding to the plurality of ports that the indoor unit information is input; and changing the address information of an indoor unit corresponding to a branch hole that provides the refrigerant, to address information of at least one indoor unit that a temperature change, corresponding to the provided refrigerant, is detected; and storing the changed address information of the at least one indoor unit.

14. The method of claim 8, further comprising:

in response to an operation command being input from a plurality of indoor units, determining a receiver of the input operation command;

in response to the receiver of the operation command being the cooling and heating system, performing an operation corresponding to the input operation command; and in response to the receiver of the operation command being the outdoor unit, transmitting the operation command to the outdoor unit.

15. An air conditioning system, comprising:

a cooling and heating system comprising a plurality of branch holes, a plurality of valves and a plurality of ports;

an outdoor unit configured to provide a plurality types of refrigerants to the cooling and heating system; and at least one indoor unit configured to receive the plurality types of refrigerants through the plurality of branch holes and emit temperature adjusted air, wherein in response to indoor unit information including refrigerant information being received from the at least one indoor unit, the cooling and heating system is configured to provide a refrigerant corresponding to the refrigerant information through a branch hole corresponding to the at least one indoor unit.

16. The system of claim 15, wherein the indoor unit information comprises address information of the at least one indoor unit corresponding to a port of the plurality of ports that the indoor unit information is received.

17. The system of claim 16, wherein the indoor unit information comprises address information of a plurality of indoor units corresponding to the port of the plurality of ports that the indoor unit information is input, and wherein the cooling and heating system is further configured to control each of the plurality of valves to provide the refrigerant corresponding to the refrigerant information to the plurality of indoor units.

18. The system of claim 17, further comprising:

a storage device configured to store the address information of the plurality of indoor units corresponding to the port of the plurality of ports, wherein the cooling and heating system is further configured to:

provide the refrigerant through a branch hole corresponding to the port of the plurality of ports, change the stored address information of the plurality of the indoor units to address information of at least one indoor unit that a temperature change, corresponding to the provided refrigerant, is detected, and store the changed address information of the at least one indoor unit.

19. The system of claim 16, wherein the cooling and heating system is further configured to, in response to the indoor unit information including a same address information of an indoor input, being input through the plurality of ports, controls each of the plurality of valves to provide the refrigerant corresponding to the refrigerant information to the indoor unit through the plurality of branch holes corresponding to the plurality of ports.

20. The system of claim 19, further comprising:

a storage device configured to store the same address information of an indoor unit corresponding to the plurality of ports, wherein the cooling and heating system is further configured to:

provide a refrigerant through one of the plurality of branch holes corresponding to the plurality of ports that the indoor unit information is input, change the address information of an indoor unit corresponding to a branch hole that provides the refrigerant, to address information of at least one indoor unit that a temperature change, corresponding to the provided refrigerant, is detected, and store the changed address information of the at least one indoor unit.

* * * * *